US008997990B2

(12) United States Patent
Gummow et al.

(10) Patent No.: US 8,997,990 B2
(45) **Date of Patent: *Apr. 7, 2015**

(54) PACKAGE OF PREMOISTENED MULTILAYERED CLEANING WIPES

(71) Applicant: The Procter & Gamble Company, Cincinnati, OH (US)

(72) Inventors: Jonathan David Gummow, Loveland, OH (US); Mark William Baize, Wyoming, OH (US); Brian Joseph Roselle, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/967,734

(22) Filed: Aug. 15, 2013

(65) Prior Publication Data

US 2015/0047994 A1 Feb. 19, 2015

(51) Int. Cl.

| | |
|---|---|
| ***B65D 25/04*** | (2006.01) |
| ***B65D 81/22*** | (2006.01) |
| ***A47L 13/17*** | (2006.01) |

(52) U.S. Cl.

CPC ..... *B65D 81/22* (2013.01); *A47L 13/17* (2013.01)

(58) Field of Classification Search

CPC ..... A47L 13/17
USPC ..... 206/494, 812, 233, 581; 15/104.93, 15/104.94
See application file for complete search history.

(56) References Cited

U.S. PATENT DOCUMENTS

| | | | | |
|---|---|---|---|---|
| 3,085,372 | A * | 4/1963 | Sweeney et al. | 401/196 |
| 3,217,353 | A * | 11/1965 | Karcher, Jr. | 15/104.94 |
| 4,601,938 | A * | 7/1986 | Deacon et al. | 428/153 |
| 4,779,386 | A * | 10/1988 | Harris | 451/557 |
| 4,797,310 | A * | 1/1989 | Barby et al. | 428/71 |
| 4,925,453 | A * | 5/1990 | Kannankeril | 604/378 |
| 5,111,934 | A * | 5/1992 | Morin | 206/229 |
| 5,487,932 | A * | 1/1996 | Dunshee | 428/68 |
| 5,628,097 | A | 5/1997 | Benson et al. | |
| 5,804,286 | A | 9/1998 | Quantrille et al. | |
| 5,840,675 | A | 11/1998 | Yeazell | |
| 5,895,504 | A | 4/1999 | Sramek et al. | |
| 5,916,661 | A | 6/1999 | Benson et al. | |
| 6,305,531 | B1 * | 10/2001 | Wilkman | 206/210 |
| 6,436,216 | B1 | 8/2002 | Grover | |
| 6,581,775 | B1 * | 6/2003 | Hagopian | 206/572 |
| 6,720,279 | B2 | 4/2004 | Cree et al. | |
| 6,811,338 | B1 * | 11/2004 | Manske et al. | 401/7 |
| 6,840,401 | B2 * | 1/2005 | Amundson | 221/56 |
| 6,863,960 | B2 * | 3/2005 | Curro et al. | 428/198 |

(Continued)

FOREIGN PATENT DOCUMENTS

| | | |
|---|---|---|
| DE | 2611880 | 9/1977 |
| DE | 2611880 A1 | 9/1977 |

(Continued)

OTHER PUBLICATIONS

PCT Search Report dtd Aug. 15, 2014; PCT/US2014/051190; 12 Pages.

*Primary Examiner* — Steven A. Reynolds
*Assistant Examiner* — King M Chu
(74) *Attorney, Agent, or Firm* — Gary J. Foose; Larry L. Huston

(57) ABSTRACT

A package including a container and a plurality of premoistened cleaning wipes.

18 Claims, 16 Drawing Sheets

(56) References Cited

U.S. PATENT DOCUMENTS

| | | | | |
|---|---|---|---|---|
| 6,993,805 | B2 | 2/2006 | Prodoehl et al. | |
| 7,030,046 | B2 | 4/2006 | Wong et al. | |
| 7,132,377 | B2 * | 11/2006 | Borgonjon et al. | 442/74 |
| 7,310,847 | B2 * | 12/2007 | Bolkan et al. | 15/118 |
| 7,610,647 | B2 * | 11/2009 | Morgan et al. | 15/104.94 |
| 7,696,109 | B2 | 4/2010 | Ouellette et al. | |
| 7,770,733 | B2 * | 8/2010 | Snell | 206/581 |
| 7,861,856 | B2 * | 1/2011 | Rowe | 206/233 |
| 7,917,985 | B2 | 4/2011 | Dorsey et al. | |
| 7,947,086 | B2 | 5/2011 | Panandiker et al. | |
| 8,267,580 | B2 * | 9/2012 | Schneider | 383/104 |
| 2003/0097725 | A1 * | 5/2003 | Smith | 15/104.93 |
| 2003/0127352 | A1 * | 7/2003 | Buschkiel et al. | 206/494 |
| 2004/0118431 | A1 | 6/2004 | Flynn | |
| 2004/0232029 | A1 * | 11/2004 | Cotert | 206/494 |
| 2005/0284777 | A1 * | 12/2005 | Wilkman | 206/210 |
| 2006/0052269 | A1 * | 3/2006 | Panandiker et al. | 510/438 |
| 2006/0180596 | A1 | 8/2006 | Young et al. | |
| 2006/0276356 | A1 | 12/2006 | Panandiker et al. | |
| 2007/0049894 | A1 | 3/2007 | Fitts et al. | |
| 2007/0062967 | A1 | 3/2007 | Zaidman et al. | |
| 2007/0130708 | A1 * | 6/2007 | Powley et al. | 15/104.94 |
| 2008/0093249 | A1 * | 4/2008 | Clough | 206/494 |
| 2012/0145737 | A1 | 6/2012 | Ray et al. | |

FOREIGN PATENT DOCUMENTS

| | | | |
|---|---|---|---|
| DE | 20005016 | U1 | 5/2000 |
| EP | 1789525 | B1 | 11/2011 |
| FR | 1236550 | A | 7/2004 |
| JP | 2010228765 | A | 10/2010 |
| WO | WO 2006/035697 | A1 | 4/2006 |
| WO | WO 2007/082375 | A1 | 7/2007 |
| WO | 2009/028952 | A1 | 3/2009 |

* cited by examiner

PACKAGE OF PREMOISTENED MULTILAYERED CLEANING WIPES

FIELD OF THE INVENTION

Disposable premoistened multilayered cleaning wipes.

BACKGROUND OF THE INVENTION

People come into contact with many surfaces in their normal everyday lives. The propensity for surfaces to harbor viruses, bacteria, dust, dander, soil, grease, hair, and like materials is well known. As people come into contact with surfaces as they move about, they are exposed to these nefarious materials. Exposure to viruses and bacteria can result in illness. Exposure to dust, dander, and pet hair can cause respiratory distress. Exposure to soil and grease can result in stained clothing. As such, devices for cleaning surfaces are desirable.

One common device provided to consumers for cleaning surfaces is a premoistened cleaning wipe. Such wipes are commonly single layers of a nonwoven fibrous material, the fibrous material being cellulosic or polyolefin material.

Typically wipes are packaged in a container in which the wipes are stacked one on top of the other with a face of the wipe facing and in contact with the closed end of the container in which the wipes are stored. Depending on the capillarity of the fibrous structure constituting the wipe, wipes at the top of the stack may not be fully wetted with the liquid cleaning composition. Cleaning composition can freely drain driven by the force of gravity. Furthermore, the magnitude of wetting may vary from little wetting for the wipes at the top of the stack to the wipes at the bottom of the stack being saturated, possibly even submerged in the liquid cleaning composition at the closed end of the package. The degree of wetting as a function of distance from the closed end of the container can depend on the nature of the capillaries of the materials constituting the wipe.

Problems of non-uniform wetting of the wipes with cleaning composition include varying product performance of the wipes as the consumer uses up the stack of wipes. Most detrimentally, the wipe at the top of the stack may be the least wetted of all of the wipes and may not have a sufficient volume of liquid cleaning composition to perform as desired. The consumer's first use of a wipe can be a poor experience, which may undermine the consumer's confidence in and satisfaction with the wipe. Wipes at the bottom of the container may be saturated, feel soggy, and drip liquid cleaning composition, resulting in a negative user experience.

In view of the problem of non-uniform wetting of premoistened wipes in a container, there is a continuing unaddressed need for a package of premoistened wipes for which the wipes are wetted uniformly.

SUMMARY OF THE INVENTION

A package comprising: a container having closed end and an opposing opening end; and a plurality of premoistened cleaning wipes contained in the container, each wipe comprising: a liquid permeable first layer, the wipe having a longitudinal axis and a longitudinal edge extending across the longitudinal axis, wherein the longitudinal edge is in contact with the closed end of the container and the wipe extends towards the opening end of the container; a channel proximal to the longitudinal edge and extending away from the closed end of the container; and a free liquid cleaning composition comprising between about 0.001% to about 10% by weight of the liquid cleaning composition of surfactant, the cleaning composition releasably absorbed in the wipe. The wipe can comprise a liquid permeable first layer joined to a liquid permeable second layer, the first layer and the second layer in a facing relationship with one another.

DETAILED DESCRIPTION OF THE INVENTION

As used herein, the term "joined" refers to the condition where a first member is attached, or connected, to a second member either directly; or indirectly, where the first member is attached, or connected, to an intermediate member which in turn is attached, or connected, to the second member either directly; or indirectly.

Cleaning wipes can be practical for consumers to use for cleaning a variety of surfaces found throughout the household. For example, it can be desirable for a consumer to use a wipe to clean counter-top surfaces, upholstery, curtains, furniture surfaces, and the like. In use, the consumer can grasp the wipe and wipe the surface. If the wipe contains a cleaning composition, the process of wiping the surface can expel at least some of the cleaning composition onto the surface. The cleaning composition can contain substances, including surfactants, to help remove soil from the surface being cleaned. As the consumer rubs the wipe against the surface to be cleaned, the wipe can lift soil from the surface being cleaned and contain the soil in the core of the wipe or on the surface of the wipe.

Figure 1:
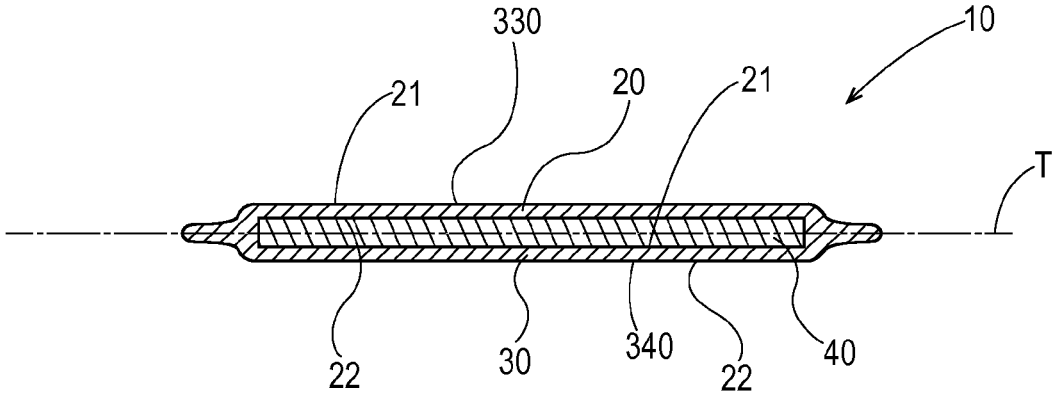
FIG. 1 is a cross sectional view of a wipe taken along the longitudinal axis as marked 1-1' in the plan view of FIG. 5.

A wipe 10 is shown in FIG. 1. As shown in FIG. 1, the wipe 10 can comprise a liquid permeable first layer 20 joined to a liquid permeable second layer 30. The first layer 20 and second layer 30 can be in a facing relationship with one another. The first layer 20 and second layer 30 can individually be generally planar webs of material or materials, each having a first surface 21 and second surface 22 opposing the first surface. The wipe 10 can have a first side 330 and an opposing second side 340. A cleaning composition can be releasably absorbed into one or more of the first layer 20, second layer 30, and a core, if present. A cleaning composition can be releasably absorbed into the interstitial spaces between fibers of one or more of the first layer 20, second layer 30, and a core, if present. A cleaning composition can be releasably absorbed into the interstitial spaces between fibers of a material selected from the group consisting of the first layer 20, second layer 30, and the core, and combinations thereof.

A core 40 can be between the first layer 20 and the second layer 30. Within the core 40, a cleaning composition can be releasably absorbed. A cleaning composition can be releasably absorbed in a material selected from the group consisting of the first layer, the core, the second, and combinations thereof. A core 40 need not be present and the cleaning composition can be releasably absorbed in one or both of the first layer 20 and second layer 30.

First Layer

The first layer 20 can be liquid permeable. That is, the first layer 20 can provide for thru-transport of cleaning composition from a core 40 to the first surface 21 of the first layer 20. Once the cleaning composition is on the first surface 21 of the first layer 20 or in the first layer 20, the cleaning composition can be delivered to the surface being cleaned.

The first layer 20 can be superimposed over the core 40. In one embodiment, the first layer 20 is associated with the core 40 by spray-gluing the first layer 20 to the surface of the core 40. In another embodiment, the core 40 can be loosely enrobed by the first layer 20 and second layer 30 without any points of attachment to one or both of the first layer 20 and second layer 30. The first layer 20 can be joined to the core 40 using any technique known in the art for joining webs of material, including, but not limited to, ultrasonic bonding and thermal bonding. It can be practical to provide a thermally embossed pattern on the first layer 20 of the wipe 10 to provide for bonding between the first layer 20 and the core 40.

The first layer 20 can be a material that is compliant and soft feeling. A suitable first layer 20 can be manufactured from a wide range of materials such as polymeric materials, formed thermoplastic films, apertured plastic films, porous films, aperture formed films, reticulated foams, natural fibers (e.g., wood or cotton fibers), woven and non-woven synthetic fibers (e.g., polyester or polypropylene fibers) or from a combination of natural and synthetic fibers. The first layer 20 can be a nonwoven comprising polyolefin fibers. A soft compliant first layer 20 can provide for a pleasant interface between the wipe 10 and the user's hand during use of the wipe 10.

Apertured formed films can be used for the first layer 20 since they are pervious to the cleaning composition and can be non-absorbent and hydrophobic. A surface of a formed film which is in contact with the surface being cleaned can remain relatively dry if the formed film is or is rendered to be hydrophobic. Moreover, apertured formed films are thought to capture and retain lint, fibrous matter such as pet hair, and the like, from the surface being treated, thereby further enhancing the cleaning benefits afforded by the wipe 10. Suitable apertured formed films are described in U.S. Pat. No. 3,929,135, entitled "Absorptive Structure Having Tapered Capillaries", issued to Thompson on Dec. 30, 1975; U.S. Pat. No. 4,324,246, entitled "Disposable Absorbent Article Having A Stain Resistant Coversheet", issued to Mullane and Smith on Apr. 13, 1982; U.S. Pat. No. 4,342,314, entitled "Resilient Plastic Web Exhibiting Fiber-Like Properties", issued to Radel and Thompson on Aug. 3, 1982; and U.S. Pat. No. 4,463,045, entitled "Macroscopically Expanded Three-Dimensional Plastic Web Exhibiting Non-Glossy Visible Surface and Cloth-Like Tactile Impression", issued to Ahr, Louis, Mullane and Ouellette on Jul. 31, 1984; U.S. Pat. No. 4,637,819 issued to Ouellette, Alcombright & Curro on Jan. 20, 1987; U.S. Pat. No. 4,609,518 issued to Curro, Baird, Gerth, Vernon & Linman on Sep. 2, 1986; U.S. Pat. No. 4,629,642 issued to Kernstock on Dec. 16, 1986; and EP0 Pat. No. 0,16,807 of Osborn published Aug. 30, 1989. A suitable apertured formed film can be a 25 gram per square meter polyethylene vacuum formed film sold as product ID PT02 by Clopay.

The apertures in such a first layer 20 may be of uniform size or can vary in size, as disclosed in the foregoing published documents, which can be referred to for technical details, manufacturing methods, and the like. Such apertures may also vary in diameter in the manner of so-called "tapered capillaries". Such formed-film cover-sheets with tapered capillary apertures can be situated over the core 40 such that the smaller end of the capillaries face the core 40 and the larger end of the capillary faces outward. The capillary apertures can provide for transport of the spent cleaning composition from the surface being cleaned to the core 40. Apertures in the formed film first layer 20 can have diameters in the range of from 0.1 mm to 1 mm, or as disclosed in the aforesaid patent references.

The first layer 20 may comprise a plurality of first apertures passing through the first layer 20 and a plurality of second apertures passing through first layer 20. The first apertures can be larger than the second apertures. Each of the first apertures can have an open area between about 0.007 $mm^2$ to about 0.8 $mm^2$. Each of the second apertures can have an open area between about 0.8 $mm^2$ and about 12 $mm^2$. Without being bound by theory, it is thought that by providing second apertures of such size that soil that is lifted from the surface being wiped can be transported through the second apertures to the core 40 and be visible on the core 40 when the user inspects the wipe 10 after use. The smaller first apertures can provide for fluid transport through the first layer 20 both when the cleaning composition is expelled from the wipe 10 and retrieved by the wipe 10 from the surface being cleaned during use. Further, a combination of smaller and larger apertures can be practical for providing for adequate fluid transport through the first layer yet still feel dry to the touch when the user uses her hand to hold the wipe 10 to rub the surface being cleaned.

The first layer 20 can be hydrophobic. However, if desired in one embodiment, the outer and/or inner surfaces of the first layer 20 can be made hydrophilic by treatment with a surfactant which is substantially evenly and completely distributed throughout the surface of the first layer 20. This can be accomplished by any of the common techniques well known to those skilled in the art. For example, the surfactant can be applied to the first layer 20 by spraying, by padding, or by the use of transfer rolls. Further, the surfactant can be incorporated into the polymeric materials of a formed film first layer 20. Such methods are disclosed in U.S. Pat. No. 5,009,653.

The first layer 20 can be a laminate of an apertured formed film as described previously and a nonwoven. The nonwoven can be made of one or more types of fibers such as those selected from the group consisting of polyester, polyethylene, polypropylene, bi-component fibers, wood, cotton, rayon, and combinations thereof. The nonwoven can be formed by known nonwoven extrusion processes such as those selected from the group consisting of melt blowing, spun bonding, carding, and combinations thereof. The nonwoven can be extensible, elastic, or inelastic. The nonwoven web can comprise polyolefin fibers. The polyolefin fibers can be selected from the group consisting of polypropylene, polyethylene, ethylene copolymers, propylene copolymers, and butane copolymers. The nonwoven can be a 28 gram per square meter 50/50 polyethylene sheath/polypropylene core bi-component fiber. The nonwoven can be a laminate of a plurality of nonwoven webs. For instance, the nonwoven can comprise a first layer of spun bonded polypropylene having a basis weight from about 6.7 grams per square meter to about 271 grams per square meter, a layer of melt blown polypropylene having a basis weight from about 6.7 to about 271 grams per square meter, a layer of melt blown polypropylene having a basis weight from about 6.7 grams per square meter to about 136 grams per square meter, and a second layer of spun bonded polypropylene having a basis weight from about 6.7 grams per square meter to about 271 grams per square meter. The nonwoven can be a spun bonded nonwoven or a melt blown nonwoven having a basis weight from about 6.7 grams per square meter to about 339 grams per square meter. The nonwoven can be a 28 gram per square meter 50/50 polyethylene sheath/polypropylene core bi-component fiber. The nonwoven fibers can be joined by bonding to form a coherent web structure. The bonding can be selected from the group consisting of chemical bonding, thermobonding, point calendaring, hydroentangling, and needle punching.

The nonwoven can be joined to an apertured formed film using techniques known in the art including melt bonding, chemical bonding, adhesive bonding, ultrasonic bonding, and the like.

Figure 2:
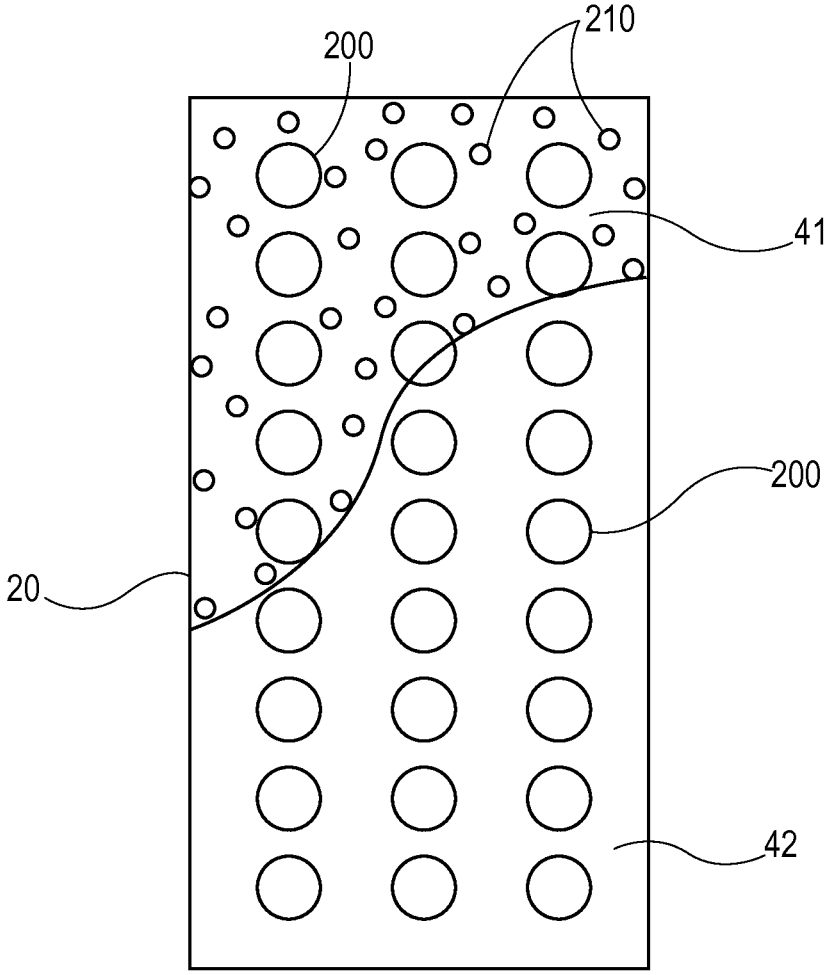
FIG. 2 is a plan view of a portion of a first layer.

A laminate of a nonwoven and apertured formed film can be formed as described in U.S. Pat. No. 5,628,097, issued to Benson and Curro, on May 13, 1997, to form the first layer 20. For such a laminate structure, the first layer 20 may comprise a plurality of first apertures 200 passing through the first layer 20 (i.e. both the apertured formed film 41 and nonwoven 42) and a plurality of second apertures 210 passing through the apertured formed film 41 but not the nonwoven 42, as shown in FIG. 2, which is an embodiment of a first layer 20 of the wipe 10. That is, the nonwoven 42 can be free from the second apertures 210. The first apertures 200 can be larger than the second apertures. Each of the second apertures 210 can have an open area between about 0.007 $mm^2$ to about 0.8 $mm^2$. Each of the first apertures 200 can have an open area between about 0.8 $mm^2$ and about 12 $mm^2$. Without being bound by theory, it is thought that by providing first apertures 200 of such size that soil that is lifted from the surface being wiped can be transported through the first apertures 200 to the core 40 and be visible on the core 40 when the user inspects the wipe after use. The second apertures 210, which can be smaller than the first apertures 200, can provide for fluid transport through the first layer 20 both when the cleaning composition is expelled from the wipe 10 and retrieved by the wipe 10 during use. Further, a combination of smaller and larger apertures can be practical for providing for adequate fluid transport through the first layer yet still feel dry to the touch when the user uses her hand to rub the surface being cleaned with the wipe 10. The first apertures 200 can be sized and dimensioned such that a user is able to view the core 40 through such apertures.

The first layer 20 can comprise an apertured film. For instance, the first layer 20 can be a 25 gram per square meter polyethylene vacuum formed film sold as product ID PT02 by Clopay. The first layer 20 can comprise a laminate of a film and a nonwoven having apertures through the laminate. The first layer 20 can comprise a laminate of an apertured film and a nonwoven. The first layer 20 can comprise a laminate of an apertured film having first apertures 200 and a nonwoven, the apertured film and nonwoven both having first apertures 200 there through. The first layer 20 can comprise a fibrous material, such as a fibrous nonwoven comprising polyolefin fibers. The first layer 20 can be an apertured fibrous material, such as an apertured fibrous nonwoven comprising polyolefin fibers.

The first layer 20 can be a spun bond nonwoven. The spun bond nonwoven can be apertured. The apertures can have an open area greater than about 0.1 $mm^2$. The fibers of the spun bond nonwoven can be bicomponent continuous fibers. The fibers of the spun bond can be blended continuous fibers. The fibers can be extruded and bonded in a single step. For bicomponent spun bond fibers, the components of the fiber can have two different melting points. For blended fibers, the component fibers of the blend can have two different melting points. The spun bond nonwoven can have a basis weight of between about 15 grams per square meter to about 80 grams per square meter.

The first layer 20 can be a coherent extensible nonwoven that is a thermally bonded spun bond nonwoven web of randomly arranged substantially continuous fibers. The spun bond nonwoven can be manufactured using a conventional spun bond process. Molten polymer is extruded in continuous filaments that are subsequently quenched, attenuated by a high velocity fluid, and collected in a random arrangement on a collecting surface. After collection of the fibers, thermal, chemical, or mechanical bonding can be performed on the fiber to form the spun bond nonwoven. The first layer can be a spun bond nonwoven referred to as SOFSPAN 200 available from Fiberweb.

Core

The core 40 can be a material that can releasably absorb a cleaning composition. In practice, the voids within the core 40 can act as a reservoir for the cleaning composition, the cleaning composition being stored within the capillaries within the core 40. The core 40 can be a fibrous material in which the capillaries are provided by the interstitial spaces between the fibers of the core 40. The core 40 can be an open celled foam in which the capillaries are provided by the interconnected pores within the foam. The core 40 can comprise a nonwoven. An economical core 40 can be provided by a nonwoven comprising polyolefin fibers.

The core 40 can comprise a layer of cellulosic material. The core can comprise an 80 gram per square meter nonwoven of bicomponent fibers, the bicomponent fibers comprising a polyethylene sheath and a polyethylene terephthalate core having a loft of about 2.5 mm. The bicomponent fibers can provide for structural integrity of the core 40 when bonded. Having an appreciable weight fraction of the core 40 made of cellulose can be economical and technically sound since cellulose is known to highly absorbent.

The core 40 can comprise a multi bonded air-laid core. The core 40 can comprise a multi bonded air-laid core comprising about 15% by weight bicomponent fibers having a polyethylene sheath and polyethylene terephthalate core, about 2.5% by weight latex, about 82% by weight pulp, and a basis weight of about 135 grams per square meter. The bicomponent fibers can provide for structural stability and rigidity of the core 40 and the latex can aid in bonding the different components of the core 40 together.

The core 40 can comprise a thermally bonded air-laid core. The core 40 can comprise a thermally bonded air-laid core comprising about 18% by weight bicomponent fibers having a polyethylene sheath and polypropylene core and about 82% pulp.

The core 40 can comprise a laminate of an 80 gram per square meter nonwoven of bicomponent fibers, the bicomponent fibers comprising a polyethylene sheath and a polyethylene terephthalate core having a loft of about 2.5 mm and two layers of a multi bonded air-laid core comprising about 15% by weight bicomponent fibers having a polyethylene sheath and polyethylene terephthalate core, about 2.5% by weight latex, about 82% by weight pulp, and a basis weight of about 135 grams per square meter. The core 40 can be a single layer thermally bonded pulp core that is 90% by weight pulp and 10% by weight bicomponent polyethylene/polypropylene fibers.

The core 40 can comprise open celled foam. For instance, the core 40 can comprise open celled foam formed from a high internal phase emulsion, such as the open celled foam described in U.S. Pat. No. 5,387,207, issued to Dyer, DesMarais, LaVon, Stone, Taylor, and Young, on Feb. 7, 1995. Open celled foams can be desirable since they can provide for a large storage volume of cleaning composition relative to the mass of the core 40.

The core 40 can comprise a material selected from the group consisting of polyolefin fibers, cellulose fibers, rayon, open celled foam, and combinations thereof.

The functions of the core 40, if present, are to store a cleaning composition prior to use, dispense cleaning composition when the wipe 10 is used to clean a surface, reabsorb spent cleaning composition after cleaning, and retain soil that has been removed by the cleaning effort. The core can have a storage volume of about 19 ml. The core can have a storage volume of between about 5 mL and about 30 mL in an uncompressed state. The core can have a storage volume of between about 12 mL and about 25 mL in an uncompressed state. The core can have a storage volume of between about 16 mL and about 25 mL in an uncompressed state.

Second Layer

The second layer 30 can be liquid permeable. That is, the second layer 30 can provide for thru-transport of liquid cleaning composition from a core 40 to the second surface 22 of the second layer 30. The second layer 30 can be superimposed under the core 40 so that the core 40 is between the first layer 20 and second layer 30. In one embodiment, the second layer 30 can be associated with the core 40 by spray-gluing the second layer 30 to the surface of the core 40. In another embodiment, the core 40 is loosely enrobed by the first layer 20 and second layer 30 without any points of attachment. The second layer 30 can be joined to the core 40 using any technique known in the art for joining webs of material, including, but not limited to, ultrasonic bonding and thermal bonding.

The second layer 30 can be a material that is compliant and soft feeling. The second layer 30 can be any of the materials as described previously as being suitable for the first layer 30. It can also be practical for the second layer 30 to be an abrasive layer.

Abrasive Layer

The wipe 10 can have an abrasive layer. The abrasive layer of the wipe 10 can be the second layer 30 of the wipe 10. Arranged as such, the first layer 20 can provide for a soft compliant wiping surface and the abrasive layer can be on the side of the core 40 opposite the first layer 20. In a simple construction, the wipe 10 can have 3 layers, a first layer 20, an abrasive layer being the second layer 30, and a core 40 disposed between the abrasive layer and first layer 20.

It is contemplated that the second layer 30 can be positioned such that the second layer 30 is between the abrasive layer and the core 40. For instance, as shown in FIG. 1, the second layer 30 can be the abrasive layer of the wipe 10. If the abrasive layer is the second layer 30, other layers of material may be between the abrasive layer and core 40, but are not necessarily needed.

If other layers are provided between the abrasive layer and the core 40, such other layers can have other functional attributes and one or more of those layers can be considered to be the second layer 30 as described herein.

The abrasive layer can be liquid permeable. That is, the abrasive layer can provide for thru-transport of liquid from a core 40 from the first surface 21 to the second surface 22 of the abrasive layer. The abrasive layer can be superimposed over the core 40. In one embodiment, the abrasive layer is associated with the core 40 by spray-gluing the abrasive layer to the surface of the core 40. In another embodiment, the core 40 is loosely enrobed by the first layer 20 and abrasive layer without any points of attachment. The abrasive layer can be bonded to the core 40 using any technique known in the art for joining webs of material, including, but not limited to, ultrasonic bonding and thermal bonding.

A suitable abrasive layer can be manufactured from a wide range of materials such as polymeric materials, formed thermoplastic films, apertured plastic films, porous films, aperture formed films, reticulated foams, natural fibers (e.g., wood or cotton fibers), woven and non-woven synthetic fibers (e.g., polyester or polypropylene fibers) or from a combination of natural and synthetic fibers.

The abrasive layer can be a material that provides an abrasive surface of the wipe 10. In use, an abrasive layer that is rough can help to dislodge soil from the surface being cleaned and can help pick up loose fibers such as dust, lint, dander, pet hair, and the like from the surface being cleaned. Further, an abrasive layer may help fluff up the fibers in textiles that are being cleaned thereby allowing for better application of the cleaning composition to the textile surface being cleaned.

The abrasive layer can comprise a net material. The net material can be a net comprised of at least two sets of strands wherein each set of strands crosses and interconnects another set of strands at a substantially fixed angle wherein strands in each set extend along a respective direction and are in substantially co-planar, spaced-apart relationship. The net material can be polypropylene or other suitably durable polyolefin material. The abrasive layer can be a material such as that sold under the trade name DELNET, by Delstar Technologies, Inc., Middletown, Del.

Figure 3A:
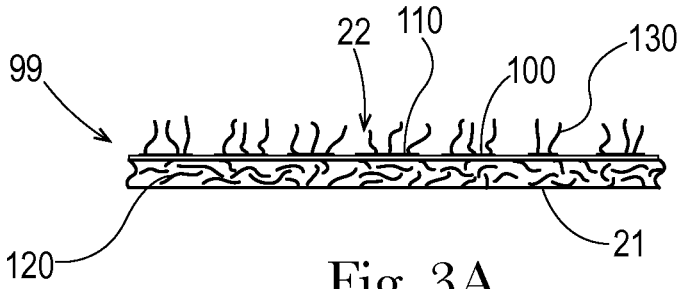
FIG. 3A is profile view of a portion of an abrasive layer.
Figure 3B:
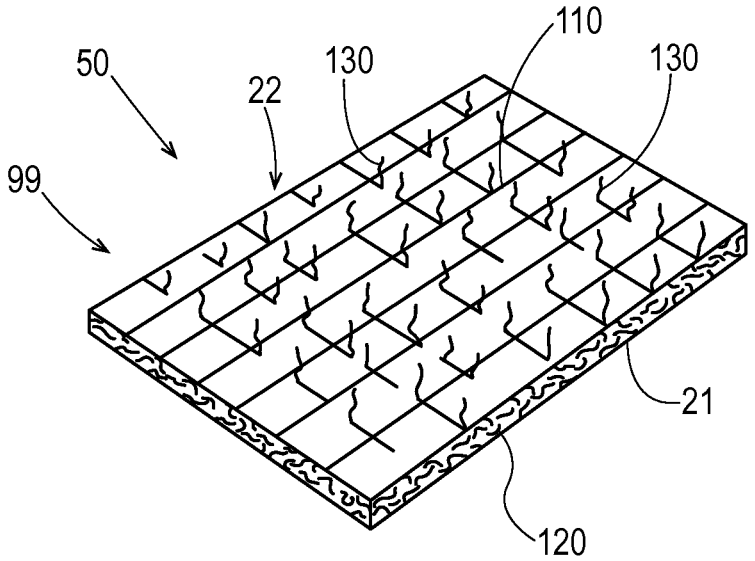
FIG. 3B is perspective view of a portion of an abrasive layer.

The abrasive layer can comprise a composite material 99 such as any of the materials described in U.S. Pat. No. 7,917,985 issued to Dorsey et al. on Apr. 5, 2011. For instance, as shown in FIGS. 3A and 3B, the abrasive layer 50 can comprise a net material 100 comprising at least two sets of strands 110 wherein each set of strands 110 crosses and interconnects another set of strands 110 at a substantially fixed angle wherein strands 110 in each set of strands 110 extend along a respective direction and are in substantially co-planar, spaced-apart relationship that is bonded to a substrate 120 wherein a plurality of the strands 110 are broken forming raised whiskers 130 that extend away from the substrate 120, as shown in FIGS. 3A and 3B. The abrasive layer 50 can be positioned to form the wipe 10 such that the whiskers 130 extend away from the core 40. That is, the second side of the wipe 10 can have whiskers 130. As the wipe 10 can be constructed, the substrate 120 can be between the net material 100 and the core 40. Together, the net material 100 and substrate 120 can form an outer layer of the wipe 10 that is the second side of the wipe 10.

The net material 100 can be a 51 grams per square meter polypropylene net (style number RO412-10PR) made by Delstar Technologies, Inc., Middletown, Del., and sold under the trade name DELNET. The net material 100 can be polypropylene net (style number RC0707-24P) made by Delstar Technologies, Inc., Middletown, Del., and sold under the trade name DELNET. The net material can have 40 strands per inch in the machine direction and 13 strands per inch in the cross direction that are bonded to one another, together forming the two sets of strands 110. The net material can be polypropylene fine square structure net referred to as PF40 and sold by Smith and Nephew Extruded Films, East Yorkshire, England. The net material 100 can be thermally bonded to one or more layers of a substrate 120 to form composite 99.

The substrate 120 can be a nonwoven or woven material. The substrate can be one or more layers of 60 grams per square meter 50% polypropylene 50% rayon spun laced nonwoven fabric. The substrate 120 can be a 60 gram per square meter polypropylene polyethylene copolymer. The substrate 120 can be SOFSPAN 120, available from Fiberweb. The composite 99 can be stressed to break a plurality of the strands 110 to form the whiskers 130. The stress can be provided, for instance, by a ring rolling process as described in U.S. Pat. No. 7,917,985 issued to Dorsey et al. on Apr. 5, 2011.

In one embodiment of the wipe 10, it can be practical for the abrasive layer 50 to be translucent. Such translucency can provide the user the ability to examine the second side of the wipe and observe that a colored second layer 30 is between the abrasive layer 50 and the core 40. A translucent abrasive layer 50 can be provided by an uncolored or lightly colored abrasive layer.

Free Liquid Cleaning Composition

To aid in cleaning, the wipe 10 can be provided with a free liquid cleaning composition. The free liquid cleaning composition can be releasably absorbed in the core 40. That is, the volume of the free liquid cleaning composition is held within the voids of the core 40 by capillary forces. For example, the free liquid cleaning composition can be held by surface tension within the interstitial spaces between fibers or within the cells of an open celled foam forming the core 40. The free liquid cleaning composition can be expelled from the core 40 by compressing the core 40. The core 40 can reabsorb spent cleaning composition into voids within the core 40 by capillary forces. The capillary forces can act to draw spent cleaning composition through the first layer 20 to the core 40.

The free liquid cleaning composition is an unencapsulated liquid cleaning composition. The free liquid cleaning composition can be releasably absorbed in a material selected from the group consisting of first layer 20, second layer 30, core 40, and combinations thereof. The free liquid cleaning composition can be releasably absorbed in constituent fibers of a material selected from the group consisting of first layer 20, second layer 30, core 40, and combinations thereof.

One practical formulation of the cleaning composition is set forth in Table 1.

TABLE 1

Cleaning composition formulation.

| Ingredient | % Active by Weight | Function |
|---|---|---|
| Distilled water | Quantity sufficient to balance to 100% | Solvent |
| Sodium lauryl sulfate | 0.90 | Anionic surfactant |
| C12/14 amine oxide | 0.30 | Cationic surfactant |
| Glycol Ether PPh | 1.50 | Solvent |
| Citric Acid 50% | Trace as needed to target pH of 7 | pH adjustment, builder |
| Korolone B-119 | 0.01 | Preservative |
| Perfume | 0.02 | Perfume |
| Dow Corning DC 2310 | 0.02 | Antifoam |

The cleaning composition can comprise between about 0.001% to about 10% by weight of the liquid cleaning composition of surfactant. The cleaning composition can comprise between about 0.1% to about 5% by weight of the liquid cleaning composition of surfactant. The cleaning composition can comprise between about 0.1% to about 4% by weight of the liquid cleaning composition of surfactant. The cleaning composition can comprise between about 0.1% to about 3% by weight of the liquid cleaning composition of surfactant. The cleaning composition can comprise between about 0.1% to about 2% by weight of the liquid cleaning composition of surfactant. Without being bound by theory, it is thought that lower mass fractions of surfactant might result in less observable residual cleaning composition left on a surface after cleaning. Higher mass fractions of surfactant might result in ringing and spotting from a locally heavy application of the cleaning composition to the surface being cleaned. The cleaning composition can comprise 0.001% to 0.1% by weight of an antifoam compound. A non-limiting example of an antifoam compound is Dow Corning DC 2310.

The cleaning wipe 10 can comprise between about 5 g to about 40 g of cleaning composition. The cleaning wipe 10 can comprise between about 15 g to about 30 g of cleaning composition.

Wipe

The wipe 10 as contemplated herein can have two sides, each having a different function. For instance, one side of the wipe can have a soft compliant surface for wiping a surface or fabric to remove light soiling, dust, and lint and the other side can have an abrasive surface that can dislodge agglomerations of soil or alter the surface of a textile so that a cleaning composition can be effectively delivered to and retrieved from the textile.

Figure 4:
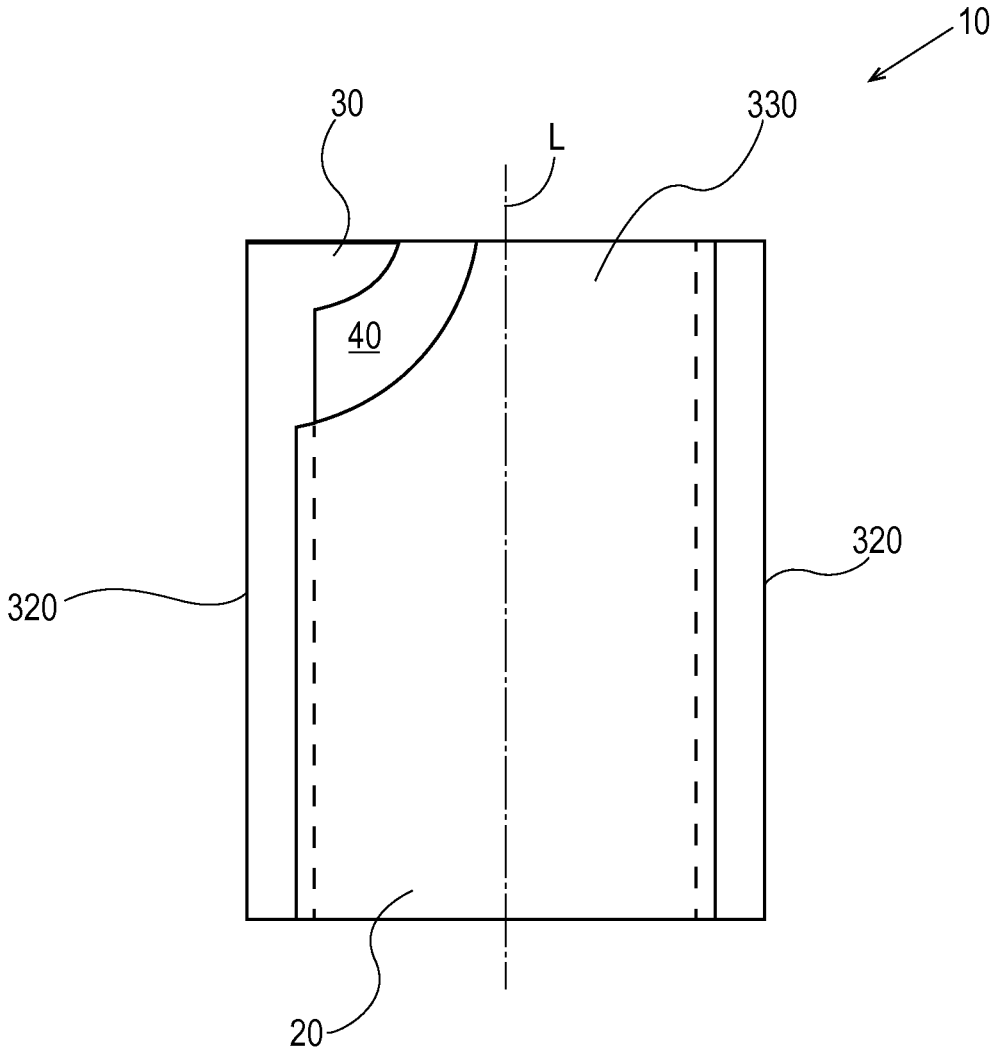
FIG. 4 is a plan view of a wipe.
Figure 5:
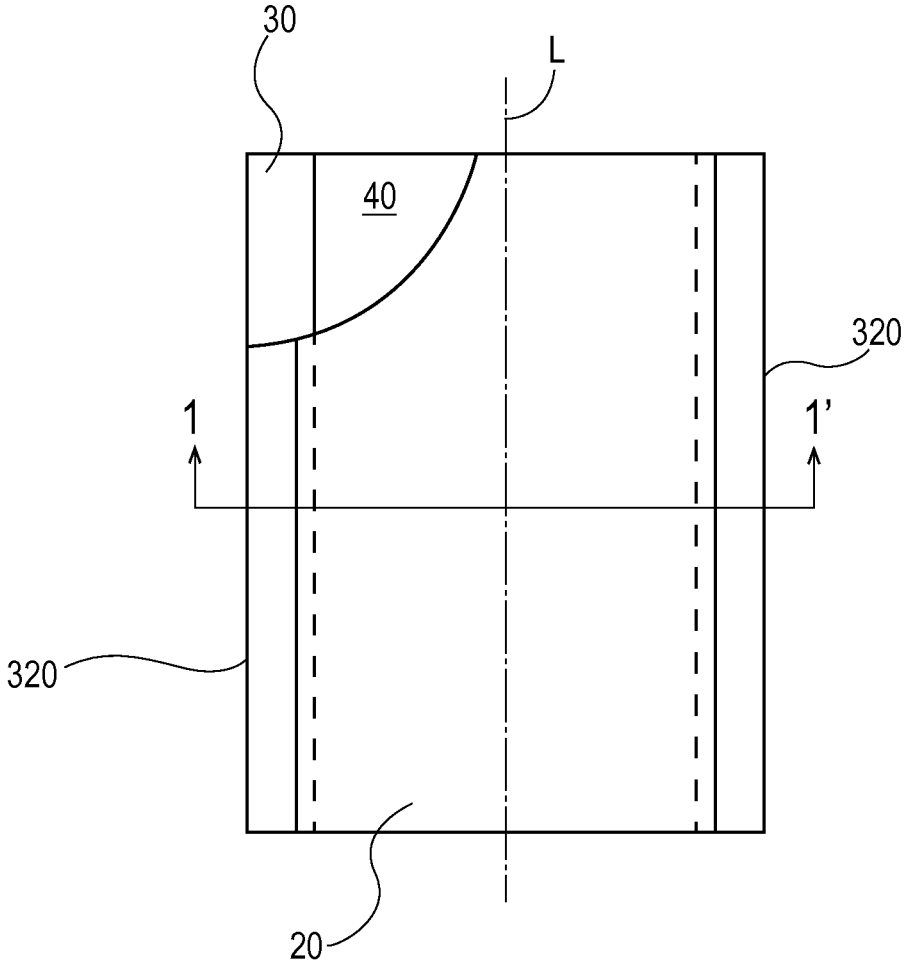
FIG. 5 is a plan view of the wipe shown in FIG. 1.

A premoistened wipe 10 having a longitudinal axis L is shown in FIGS. 4 and 5. The wipe 10 can have a liquid permeable first layer 20 joined to a liquid permeable second layer 30. The first layer 20 and the second layer 30 can be in a facing relationship with one another. By facing relationship, it is meant that the two components rest generally flat relative to one another so that one planar surface of one component faces a planar surface of the other component, like a floor mat rests on the floor. Two components can be in a facing relationship yet still have other components positioned between the two components that are in a facing relationship, for instance like a sandwich that has a slice cheese positioned between two slices of bread that are in a facing relationship.

For instance, the wipe 10 can be designed so that the core 40 is absent between the first layer 20 and second layer 30 proximate the transverse edges 320. The first layer 20 and the second layer 30 can be joined directly to one another so that the first layer 20 and second layer 30 are in direct contact with one another.

As shown in FIGS. 4 and 5, the first layer 20 and second layer 30 can be joined to one another along each transverse edge 320. The first layer 20 can be an apertured film, and apertured formed film, a nonwoven, woven material, or a composite material of such constituents.

In one embodiment of the wipe 10, the first layer 20 can form the first side 330 of the wipe 10 and the wipe 10 can have a second side 340 opposing the first side 330 of the wipe 10.

Figure 6:
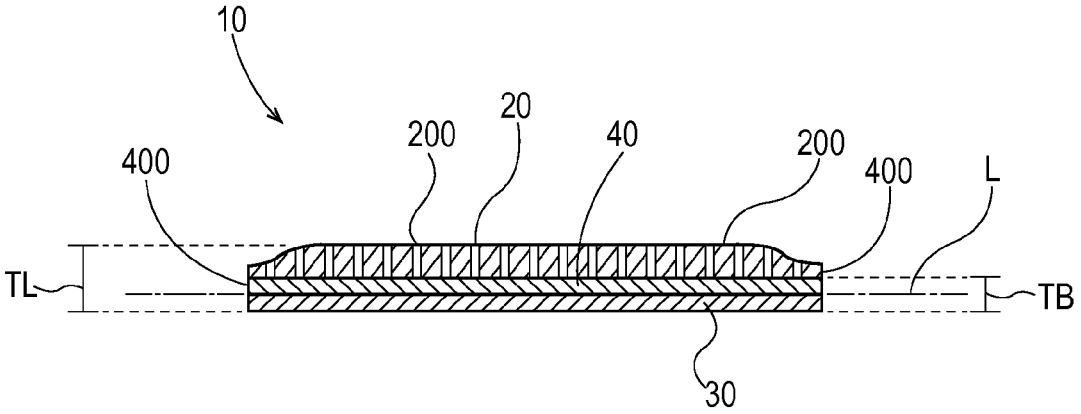
FIG. 6 is cross sectional view of a wipe cut along the longitudinal axis.

As shown in FIG. 4, the first layer 20 can form a first side 330 of the wipe 10. The wipe 10 can have a variety of constructs including any of those discussed previously. In the construction shown in FIG. 1, the first layer 20 and second layer 30 can be joined to one another, for instance by melt bonding, chemical bonding, adhesive bonding, ultrasonic bonding, and the like. The first layer 20 and second layer 30 can be joined to one another along the transverse edges 320. The transverse edges 320 are spaced apart away from the longitudinal axis L. The transverse edges 320 can be straight lines or nonlinear, for instance a decorative scalloped pattern. The first layer 20, second layer 30, and core 40 can be coextensive with one another along the longitudinal axis L, as shown in FIG. 1. The first layer 20, core 40, and second layer 30 can be joined together at the longitudinal ends of the wipe 10, as shown in FIG. 6. In an alternative arrangement, the first layer 20 and second layer 30 can be joined to one another along the transverse edges 320 and along the longitudinal ends to form a pocket in which the core 40 is positioned. In such an arrangement, the first layer 20 and second layer 30 can be longitudinally more extensive than the core 40 so that at the longitudinal ends of the wipe 10, the core 40 is not between the first layer 20 and second layer 30. That is, the longitudinal ends/longitudinal edge bonds of the wipe 10 can be free of material from the core 40. The first layer 20 and second layer 30 can extend longitudinally beyond the core 40 and extend further away from the longitudinal axis L than the core 40, thereby forming a pouch within which the core 40 is positioned. Arranged as such, the transverse edges 320 can be free of material from the core 40.

As shown in FIG. 6, the wipe 10 can comprise a pair of longitudinal edge bonds 400 disposed at opposing longitudinal edges of the wipe 10 across the longitudinal axis L. Each longitudinal edge bond 400 can comprise material from the first layer 20, the core 40, and the second layer 30. By having longitudinal edge bonds 400 that include the core 40, the longitudinal edge bonds 400 can have a greater resistance to bending as compared to other portions of the wipe 10, for instance as compared to the transverse edge bonds 410. The longitudinal edge bonds 400 can have a greater resistance to bending than the transverse edge bonds 410 of the wipe 10. Having a different resistances to bending between these two parts of the wipe 10 can be beneficial in that the stiffer part can be more suitable for cleaning one type of feature, such as the crease between cording and fabric on a sofa, and the more flexible part can be used to lightly brush a delicate surface, such as the leaf of decorative plant.

Resistance to bending can be measured by separating the relevant bond from the wipe and using a two point bending test with the resistance to bending quantified as the force required to deflect the free end of the beam of bond material 10% of the length of the beam of bond material.

Similarly, the longitudinal edge bonds 400 can be thicker than the transverse edge bonds 410, the thickness being measured orthogonal to the longitudinal axis L and out of plane with respect to the first layer 20 and the second layer 30. This difference in thickness can provide for the availability of the wipe 10 to fit into different size cracks, crevices, and creases.

Stiff longitudinal edge bonds 400 can be useful for cleaning narrow creases and folds in surfaces. If the longitudinal edge bonds 400 are floppy, as might be the case if only the first layer 20 and second layer 30 are bonded to one another to enclose the core 40, it might be difficult for the user to slip the wipe 10 edgewise into a narrow crease, crevice, or fold. It is thought that the stiff longitudinal edge bonds 400 can be useful for cleaning the crease between the sole of a dress shoe and the body of the shoe. The stiff longitudinal edge bonds 400 might also be useful for cleaning the crease between the textile on a sofa and decorative cording that is commonly found around the edges of components of the sofa such as the cushions, arm rests, and decorative contours, where dirt, food crumbs, dander, and pet hair often accumulate. The stiff longitudinal edge bonds 400 might also be useful for cleaning between the keys of a computer keyboard or piano, within the contours of the facings and buttons of electronic devices such as televisions and stereos, around the edges of picture frames, and other hard to reach narrow creases, cracks, and crevices.

If desired, the longitudinal edge bonds 400 can be continuous or intermittent. Continuous longitudinal edge bonds 400 can be stiffer than intermittent longitudinal edge bonds 400.

Longitudinal edge bonds 400 can be provided for by thermally bonding the first layer 20, second layer 30, and core 40 to one another. As shown in FIG. 6, the longitudinal edge bonds 400 can have a longitudinal edge bond 400 minimum thickness TB and the wipe 10 can have a maximum thickness TL along the longitudinal axis L. The longitudinal edge bond 400 minimum thickness TB and the maximum thickness TL are both measured orthogonal to the longitudinal axis L and out of plane with respect to the first layer 20 and the second layer 30. The longitudinal edge bond 400 minimum thickness TB can be less than about 80% of the maximum thickness TL. The longitudinal edge bond 400 minimum thickness TB can be less than about 30% of the maximum thickness TL. Without being bound by theory, it is thought that relatively thin longitudinal edge bonds 400 can be beneficial in that they can readily enter narrow creases, cracks, and crevices and be used to clean such features. Further, by having a fatter part of the wipe 10 somewhat away from the thin longitudinal edge bond 400 the wipe can be stuffed to fit into narrow cracks, creases, and crevices, thereby providing for better cleaning, particularly around the exit from such features which may be the most visually apparent portion of the feature.

The maximum thickness TL of the wipe 10 can be between about 3 mm to about 10 mm, or about 3 mm to about 8 mm, or 3 mm to about 6 mm. Longitudinal edge bonds 400 that comprise the first layer 20, second layer 30, and core 40 can have a longitudinal edge bond 400 minimum thickness TB between about 0.1 mm and 2.4 mm. The thickness of the longitudinal edge bonds 400 and the transverse edge bonds 410 can be controlled by, for example, altering the pressure and/or heat applied that portion of the wipe 10 to form the respective bond. Higher pressure and greater amounts of heat can be associated with stiffer and or thinner bonds.

Figure 7:
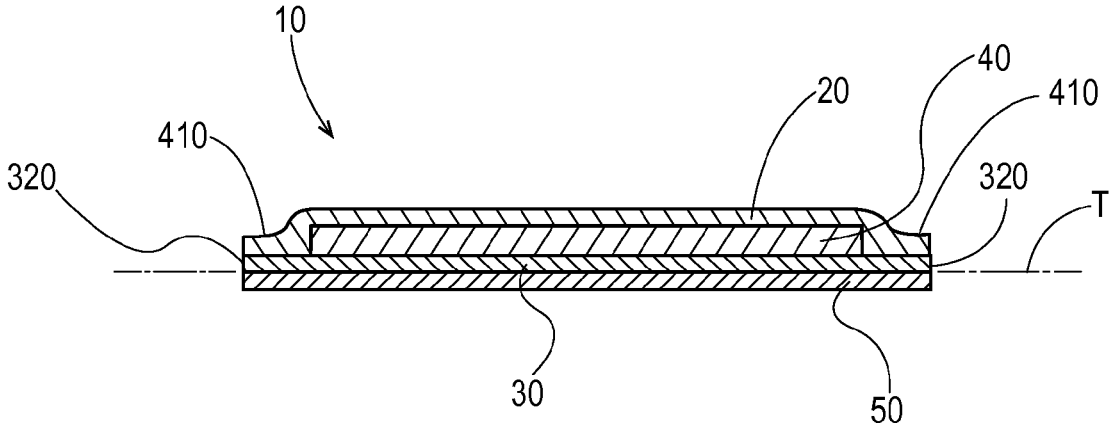
FIG. 7 is a cross sectional view of a wipe taken across the longitudinal axis.

The second layer 30 can be a layer that is an interior component of the wipe 10, as shown in FIG. 7. As shown in FIG. 7, the core 40 can be positioned between the first layer 20 and the second layer 30. The second layer 30 can be colored, as described previously, for instance by a dye, pigment, ink, or other technique. The second layer 30 can be between the core 40 and the abrasive layer 50. The abrasive layer 50 can form an exterior surface of the wipe 10 that can be used to dislodge soil from the surface being cleaned. The first layer 20, second layer 30, and abrasive layer 50 can be joined to one another along the transverse edges 320, for instance by thermally bonding the three materials together. The second layer 30, if colored, can be visible through the first layer 20 at positions where the first layer 20 and second layer 30 are joined to one another and the core 40 is not between the first layer 20 and second layer 30.

Figure 8:
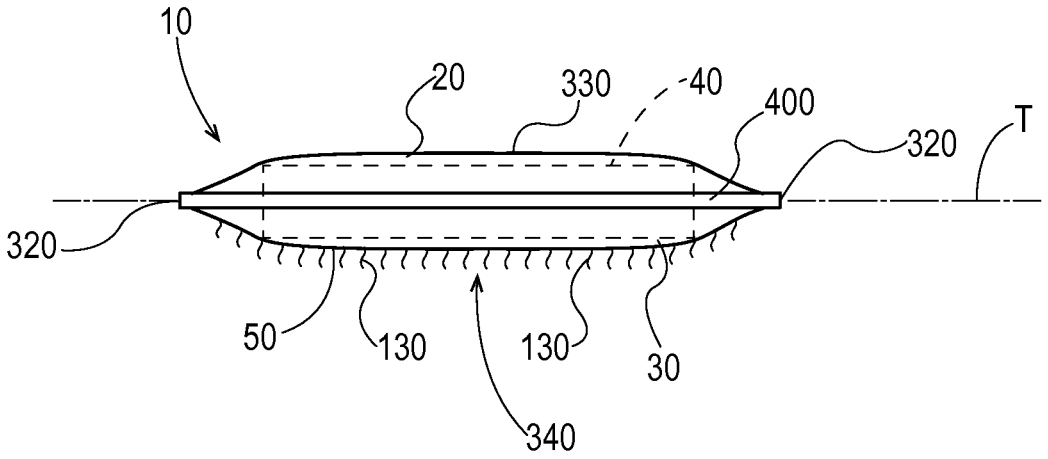
FIG. 8 is a side view of a wipe taken in line with the longitudinal axis.

As shown in FIG. 8, the abrasive layer 50 can be the second layer 30. That is, the wipe 10 can comprise first layer 20 and a second layer 30 and a core 40 positioned between the first layer 20 and second layer 30, wherein the second layer 30 is an abrasive layer 50. The abrasive layer 50 can be colored. The abrasive layer 50 can be colored with a material selected from the group consisting of dye, pigment, ink, and combinations thereof.

Figure 9:
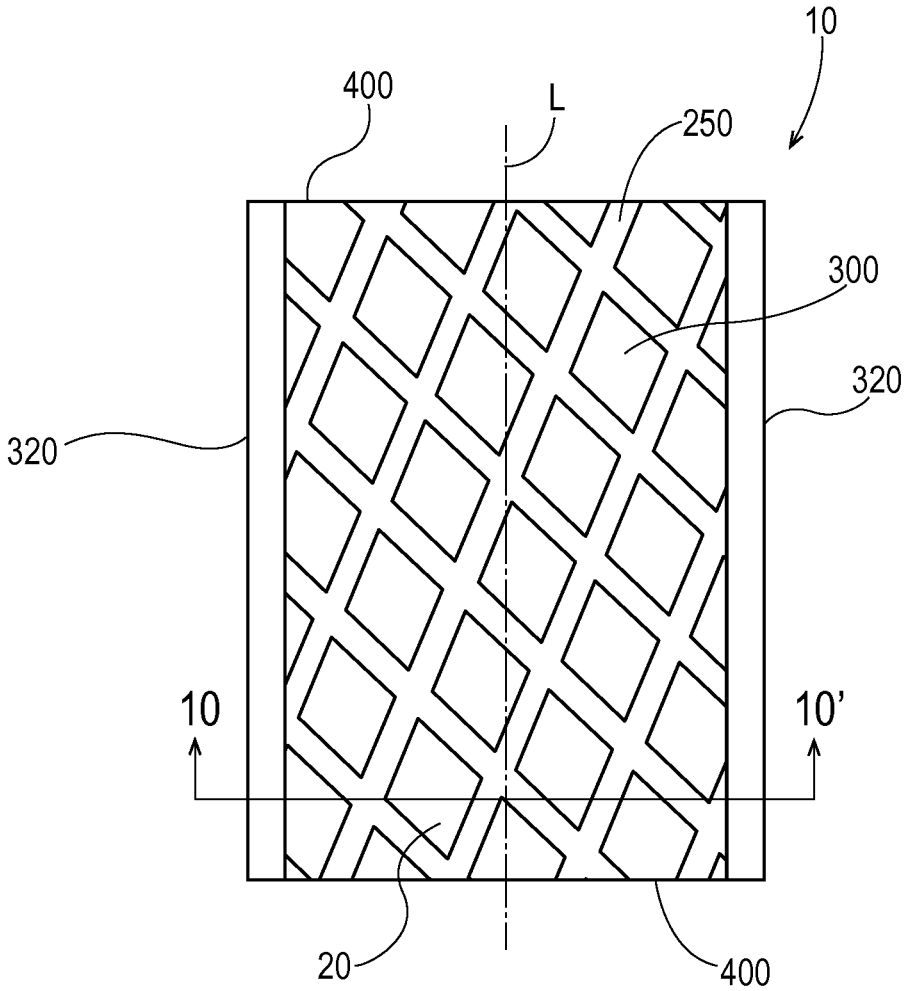
FIG. 9 is a plan view of a wipe having channels.
Figure 10:
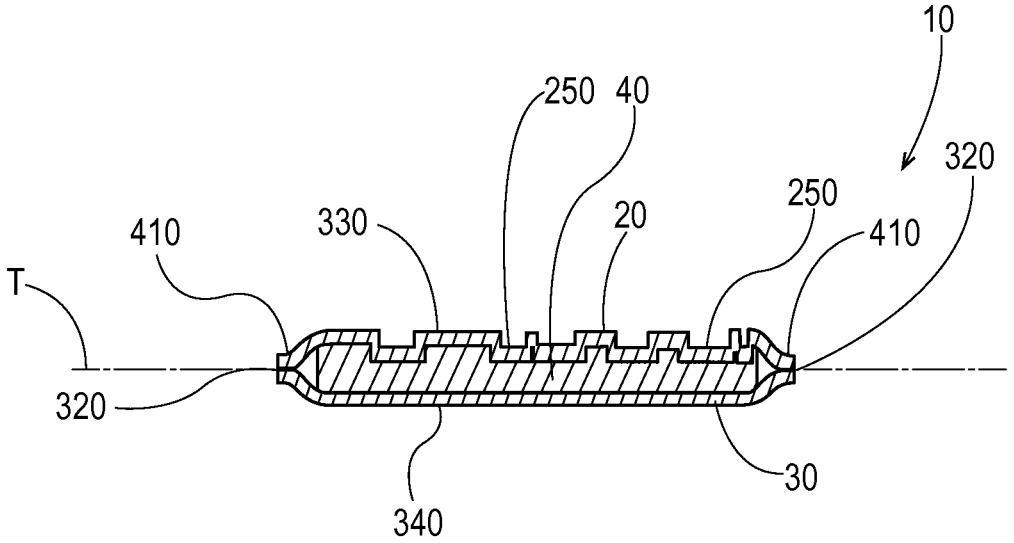
FIG. 10 is a cross sectional view of the wipe shown in FIG. 10 marked 10-10'.

The first layer 20 can form a first side 330 of the wipe 10. As shown in FIGS. 9 and 10, the first side 330 of the wipe 10 can comprise one or more channels 250 embossed into the core 40. Embossed channels 250 can increase the stiffness of the wipe 10 and increase the durability of the wipe 10.

As shown in FIG. 10, the embossed channels 250 can provide for pillowed regions on the wipe 10 which impart a three-dimensional surface profile from the generally planar surface of the first layer 20. Channels 250 can be embossed into the wipe 10 in any manner known in the art including embossing, fusion bonding, thermal bonding, and the like for impressing a pattern upon a substrate. Without being bound by theory, it is thought that channels 250 provide for regions of a fibrous substrate that have a higher capillary potential than regions of the fibrous substrate that are devoid of channels 250. The increased capillarity is provided for by the close proximity of the fibers constituting the fibrous substrate. Channels 250 can provide for pathways of enhanced capillarity throughout the wipe 10, thereby promoting widespread distribution of the liquid cleaning composition in the wipe 10.

The channels 250 can be continuous channels 250. The channels can be discontinuous channels 250. Discontinuous channels can provide for the pathways of enhanced capillarity in the same manner as continuous channels 250 provided that the spacing between channel segments 26 of the channel 250 are sufficiently small so that fluid can still be conducted from one channel segment to another. For discontinuous channels, the spacing between segments of the channel 250 can be less than the length of the channel segments 26.

Figure 11:
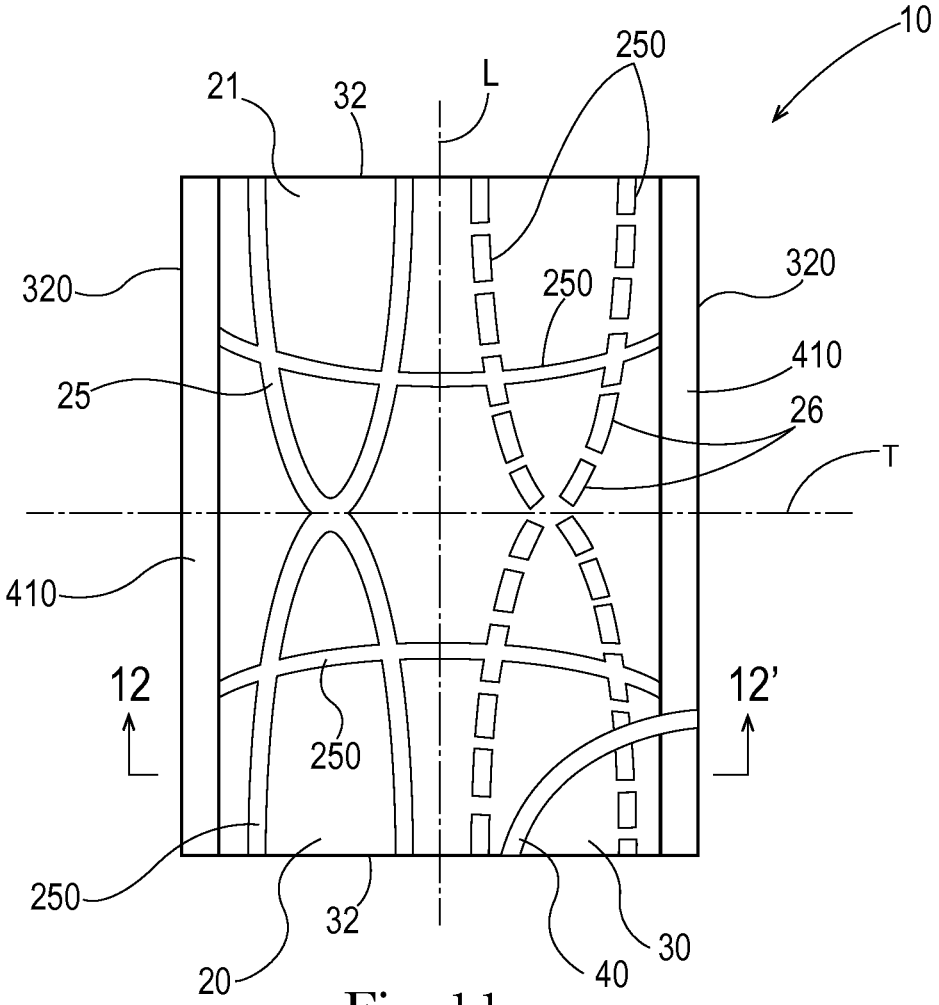
FIG. 11 is a plan view of a wipe having channels.

As shown in FIG. 11, a channel 250 can extend away from a longitudinal edge 32. The longitudinal edge 32 can extend across the longitudinal axis L. By having the channel 250 extend all the way to the longitudinal edge 32, the liquid cleaning composition might be distributed all the way to the opposing longitudinal edge 32 of the wipe 10, thereby providing enhanced efficacy of the wipe 10. The wipe 10 can comprise a plurality of channels 250 each of which extend away from or proximal to the longitudinal edge 32, with an increased number of channels 250 thought to provide for enhanced distribution of the cleaning composition. One or more channels 250 can extend from one longitudinal edge 32 to an opposing longitudinal edge 32. That is, one or more channels 250 can extend between the longitudinal edges 32. Such an arrangement can be practical for distributing cleaning composition along the entire extent of the wipe 10 in longitudinal direction. Further, channels 250 that are generally oriented in the longitudinal direction can provide for enhanced stiffness of the wipe 10 with respect to bending about the transverse axis T.

The wipe 10 can have a longitudinal axis L and a transverse axis T intersecting and orthogonal to the longitudinal axis L and in plane with the wipe 10. The longitudinal axis L can be longer than the transverse axis T. In other words, the length of the wipe 10 measured along the longitudinal axis L can be longer than the width of the wipe 10 measured along the transverse axis T. The longitudinal axis L can be shorter than the transverse axis T. That is, the length of the wipe 10 measured along the longitudinal axis L can be longer than the width of the wipe 10 measured along the transverse axis T. The longitudinal axis L can be taken to be in a direction away from the closed end of the container. The wipe 10 can extend between transverse edges 320 that are disposed across the transverse axis T.

The wipe 10 can have a longitudinal axis L and the wipe 10 can extend between longitudinal edges 32 disposed across the longitudinal axis L. The channels 250 can extend from one or both of the longitudinal edges 32. The wipe 10 can have transverse axis T orthogonal to the longitudinal axis L and in plane with the wipe 10 and the wipe 10 can extend between the transverse edges 320. The channels 250 can extend from one or both transverse edges 320. One or more channels 250 can extend between the transverse edges 320.

Figure 12:
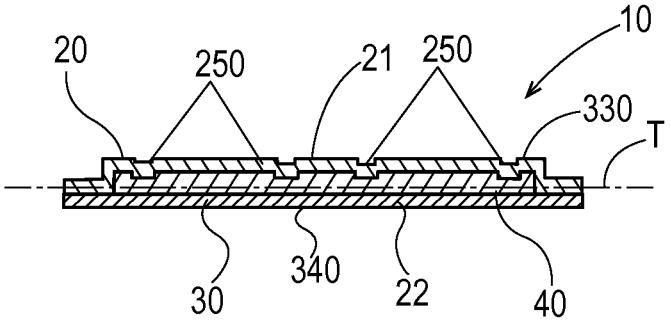
FIG. 12 is a cross sectional view of a wipe taken along the longitudinal axis as marked 12-12' in the plan view of FIG. 11.

A channel 250 can be formed in one or more layers of the wipe 10, as shown in FIG. 12. A channel 250 can comprise material from one or more of the first layer 20, the core 40, and the second layer 30. A channel 250 can comprise a material selected from the group consisting of the first layer 20, the core 40, the second layer 30, and combinations thereof. Channels 250 in one or more of the layers comprised of a non-woven material can be practical. The wipe 10 can comprise intersecting channels 25. Optionally, the channels 250 can be spaced apart from one another.

Figure 13:
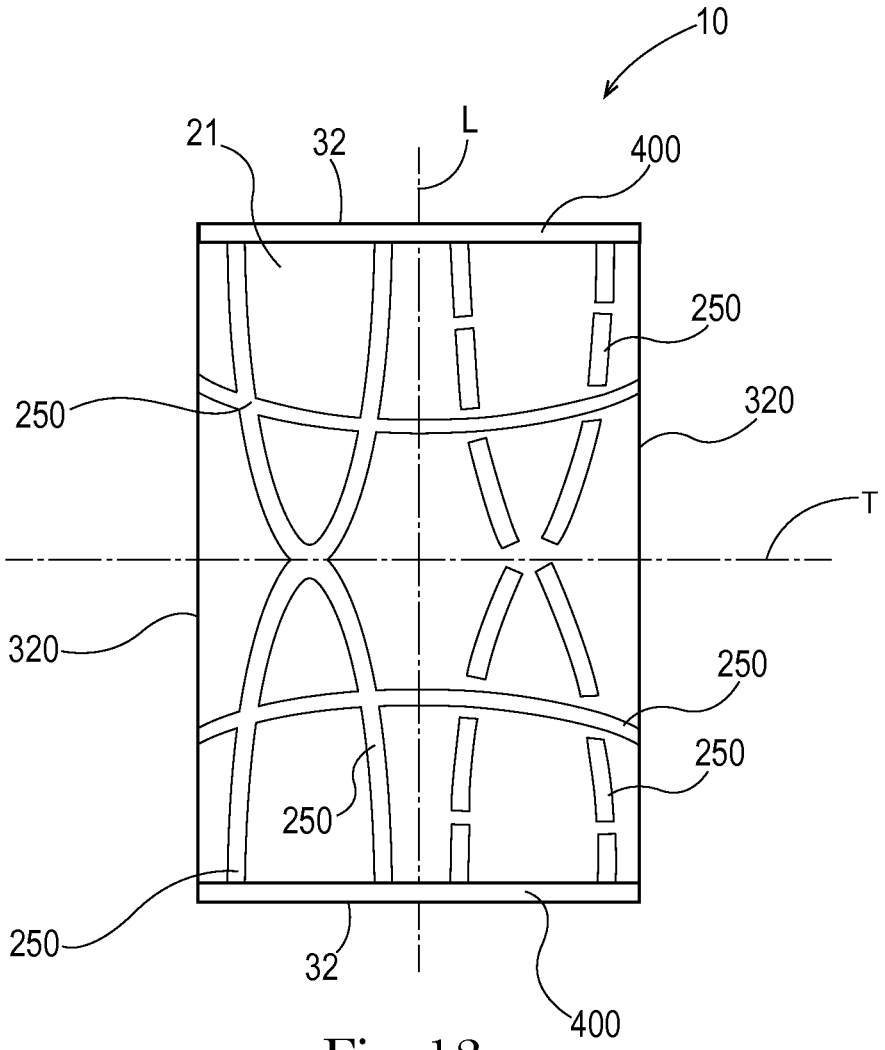
FIG. 13 is a plan view of a wipe.

A channel 250 need not extend all the way to the longitudinal edge 32. As shown in FIG. 13, the wipe 10 can have one or more longitudinal edge bonds 400. A channel 250 can extend away from the edge bond 400. It is contemplated herein that the wipe 10 can comprise a plurality of such channels 250. The channels 250 can extend away from the longitudinal edge bond 400 to an opposing longitudinal edge bond 400. As described and shown herein, the longitudinal edge bond 400 can comprise material selected from the group consisting of the first layer 20, the second layer 30, the core 40, and combinations thereof. The longitudinal edge bond 400 can provide for a dense fibrous structure having high capillarity.

Channels 250 can also be beneficial for helping the wipe 10 maintain distribution of the cleaning composition in the wipe 10 when the wipe 10 is packaged such that the package is designed so that one of the longitudinal edges 32 is oriented towards the bottom of the package. In such an arrangement, if the pore sizes of the materials constituting the wipe 10 are so large such that the capillary potential of any part of the wipe 10 is less than the length of the wipe 10 along the longitudinal axis L, the wipe 10 may not be wetted across the entire length along the longitudinal axis L. The channels 250 can help draw up any cleaning composition that is contained in the bottom of the package higher up into the wipe in the longitudinal direction. The depth of the channels 250 can be greater than about 0.25 mm.

One or more channels 250, continuous or segmented, can extend between the transverse edge bonds 320, by way of non-limiting example as in FIG. 11. Plurality of channels 25, continuous or segmented, can extend between the transverse edge bonds 320. Such channels 250 can promote distribution of the cleaning composition laterally in the transverse direction and provide for enhanced bending stiffness about the longitudinal axis L. One or more channels 250, continuous or segmented, can extend between the transverse edges 320, by way of non-limiting example as shown in FIG. 13.

Figure 14:
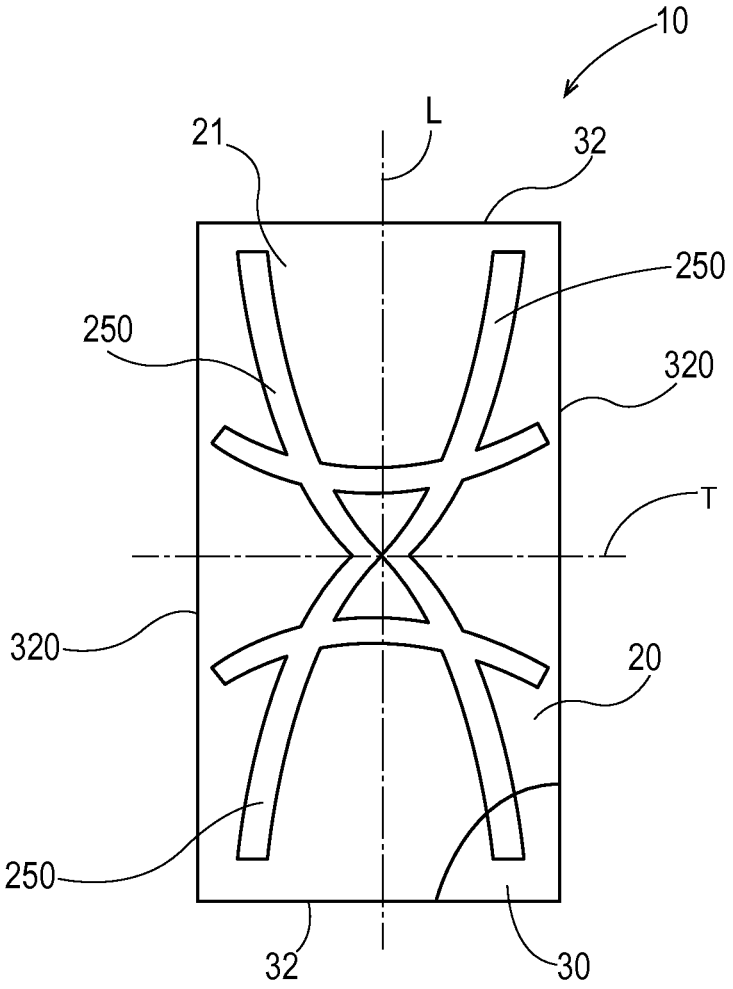
FIG. 14 is a plan view of a wipe.

The wipe 10 can comprise a first layer 20, second layer 30 in facing relationship with the first layer 20, a plurality of channels 25, and a free liquid cleaning composition releasably absorbed in wipe 10, for example as shown in FIG. 14. The cleaning composition can be releasably absorbed in a layer selected from the group consisting of the first layer 20, the second layer 30, core 40, and combinations thereof. A core 40 can be disposed between the first layer 20 and the second layer 30. The channels 250 can extend from the longitudinal edge 32. The channels 250 can extend proximal to the longitudinal edge 32. The channels 250 can extend between the longitudinal edges 32. The channels 250 can extend from the transverse edge 320. The channels 250 can extend proximal to the transverse edge 320. The channels 250 can extend between the transverse edges 320. The channels 250 can extend to within less than about 10 mm of the longitudinal edge 32 and or transverse edge 320.

Since the wipe 10 can be designed to use as a hand implement, the wipe 10 can be sized and dimensioned to conform to an adult human hand. For instance, the wipe 10 can have a length, as measured along the longitudinal axis L of between about 8 cm and about 14 cm. The wipe 10 can have a maximum width, as measured orthogonal to the longitudinal axis L and in plane with the first layer 20 of between about 5 cm and about 12 cm.

Fluid Expression

To provide for different sides of the wipe 10 having different functions, it can be practical to make the first side 330 express liquid cleaning composition from the core 40 at a different amount or rate as compared to the second side 340. For instance, if the first side 330 of the wipe 10 is being used by the consumer for wiping a sofa, the user's objective may be removal of light dust and pet hair. The cleaning capability of the wipe 10 for cleaning light dust and pet hair may not require as much cleaning composition to be effective as compared to a cleaning effort on more heavily soiled surfaces employing the second side 340 of the wipe 10. As such, it may be beneficial to have first side 330 express liquid more slowly or in a lower quantity than the second side 340. The quantity of liquid cleaning composition expressed from a particular side of the wipe 10 can be quantified by the cumulative wipe fluid loss value. To provide for a marked difference in cleaning composition expression, the first side 330 and second side 340 can each have an individual cumulative wipe fluid loss value and the cumulative wipe fluid loss value of the first side 330 and the cumulative wipe fluid loss value of the second side 340 can differ by more than about 10%. Such a difference can provide for a user noticeable difference in cleaning composition expression from the first side 330 as compared to the second side 340. If desired, the cumulative wipe fluid loss value of the second side 340 can be more than about 10% greater than the cumulative wipe fluid loss value of the first side 330. Such an arrangement can be practical if the first side 330 is designed for light cleaning and the second side 340 is designed for more heavy cleaning.

The cumulative wipe fluid loss value is measured as follows. A stack of layers of Ahlstrom filter paper grade 989 supplied by Empirical Manufacturing Company (or equivalent) is provided. The number of layers needs to be sufficient so that at least the bottom 3 layers are substantially dry after completion of the test so that the stack of filter paper is not wetting through. A layer is considered substantially dry if the percent change in the mass of the layer in percent post-test as compared to the pre-test dry mass is less than 1%. The dimensions of each layer of filter paper need to extend laterally beyond the wipe being tested by 13 mm. The filter paper is conditioned in advance of the test for at least 12 hrs at a temperature of 21.1° C.+/−1° C. and a relative humidity of 65% and the measurement of the cumulative wipe fluid loss value is measured under the same conditions. The wipe is temperature conditioned for 12 hours at 21.1° C.+/−1° C. The wipe is tested in its as wetted state.

The wipe being tested, which has cleaning composition absorbed therein, is weighed using a Sartorius E2000D laboratory balance. Then the wipe is placed flat and centered onto the stack of filter paper. A rigid non-porous weight having an area greater than the area of the wipe is applied to the wipe so that the pressure applied to the wipe is 5.59 kPa+/−0.34 kPa. The area used to compute the pressure is the plane area of the wipe minus the area of any bond(s) about the periphery of the wipe.

The pressure is applied to the wipe within 1 second in a manner such that the pressure applied does not exceed 5.59 kPa+/−0.34 kPa at any time during the pressure application and then left on the wipe so that the total pressure is supported by the wipe for 30 seconds. After 30 seconds, the applied pressure is removed and the wipe is immediately weighed using the laboratory balance. The difference in weight of the wipe before the pressure is applied and after the pressure is applied and removed is the cumulative wipe fluid loss value for the side of the wipe facing the filter paper layers. A fresh wipe and fresh filter paper is used for each measurement of cumulative wipe fluid loss value that is made.

Specimens of wipe 10 were constructed as follows. All components of the wipe, except the core, had dimensions of 8.89 cm by 11.43 cm. The core 40 had dimensions of 7.94 cm by 11.43 cm. The core 40 formed part of the longitudinal edge bonds and was not part of the lateral edge bonds. The wipe consisted of the following layers, progressing from the first side to the second side: a 25 gram per square meter polyethylene vacuum formed film sold as product ID PT02 by Clopay and a 28 gram per square meter 50/50 polyethylene sheath/polypropylene core bi-component fiber laminated together using the process in U.S. Pat. No. 5,628,097, issued to Benson and Curro, on May 13, 1997; a layered core of a laminate of an 80 gram per square meter nonwoven of bicomponent fibers, the bicomponent fibers comprising a polyethylene sheath and a polyethylene terephthalate core having a loft of about 2.5 mm overlying two layers of a multi bonded air-laid core comprising about 15% by weight bicomponent fibers having a polyethylene sheath and polyethylene terephthalate core, about 2.5% by weight latex, about 82% pulp, and a basis weight of about 135 grams per square meter; two layers of 15 gram per square meter polypropylene nonwoven, and the bottom layer was laminate of a 60 gram per square meter SOFSPAN 120 nonwoven, available from Fiberweb and a polypropylene fine square structure net PF40 sold by Smith and Nephew Extruded Films, East Yorkshire, England, the layers being combined following the process in U.S. Pat. No. 7,917,985 issued to Dorsey et al. on Apr. 5, 2011, with the net material being on the second side of the wipe/oriented towards the exterior of the wipe. Each wipe was loaded with 19 g+/−0.3 g of cleaning composition according to Table 1.

The cumulative wipe fluid loss value of the side of the wipe having the netting material was 7.86 g with a standard deviation of 0.15 g, based on the average of six specimens tested. The cumulative wipe fluid loss value of the side of the wipe having the vacuum formed film was 9.92 g with a standard deviation of 0.30 g, based on the average of six specimens tested. The cumulative wipe fluid loss value of the side of the wipe having the netting material was 26% greater than the cumulative wipe fluid loss value of the side of the wipe having the vacuum formed film.

Packaging

Figure 15:
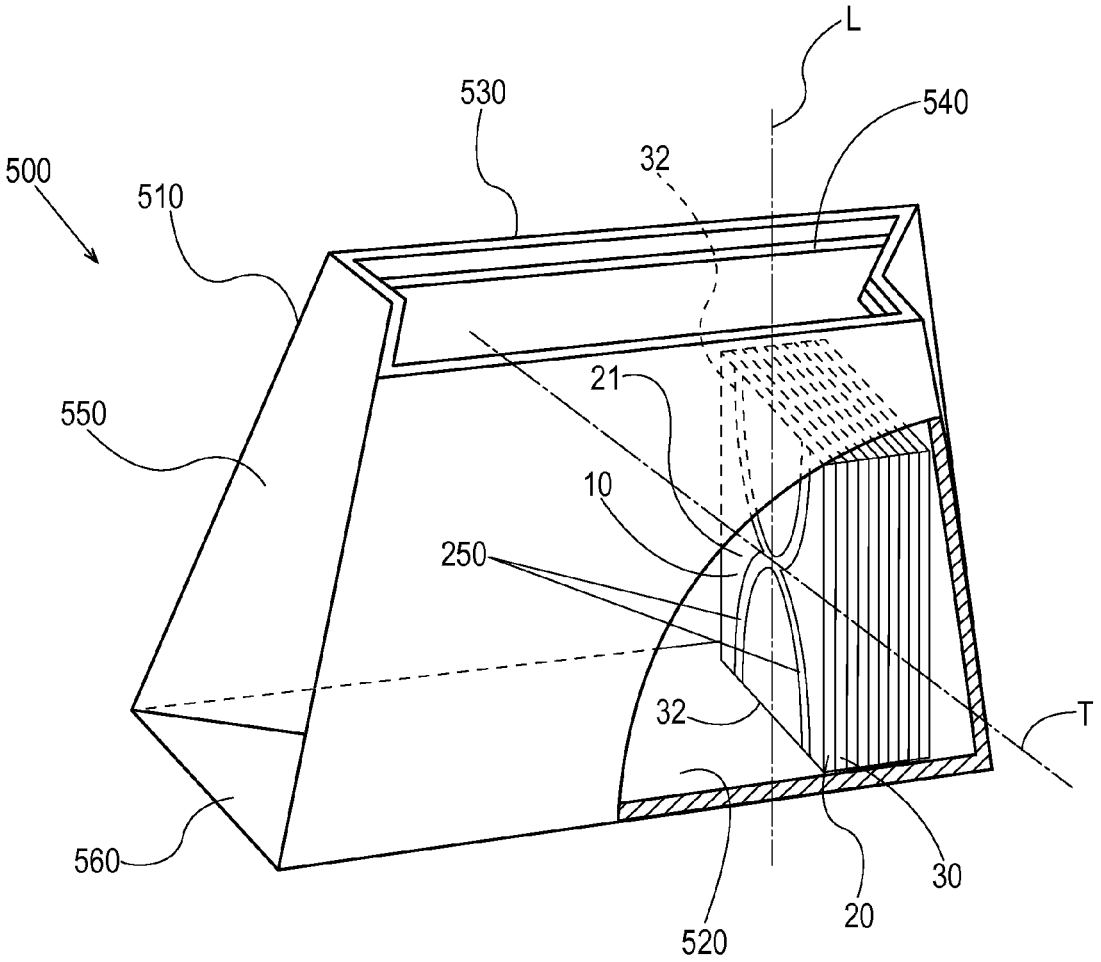
FIG. 15 is a package comprising a container and a plurality of wipes in which the container is a bag.

A package 500 comprising a container 510 and a plurality of premoistened cleaning wipes 10 contained in the container 510 can be provided to the consumer, for example as shown in FIG. 15. When the consumer desires to use a wipe 10, the wipe is desirably wetted throughout the wipe 10 with the free liquid cleaning composition.

During manufacturing of the wipe 10, wetting of the wipes 10 is desirably the last step in the process so as to minimize the potential for the cleaning composition to contaminant the manufacturing line equipment. This can be accomplished by packaging the wipes 10 in a container 510 in a dry condition. That is no moisture beyond the hygroscopic moisture of the constituent materials of the wipe 10. Once the wipes 10 are in the container 510, the free liquid cleaning composition can be sprayed or poured into the container 510 to wet the wipes 10 with the cleaning composition prior to closing the package 500.

Since the wipes 10 can be comprised of multiple layers, for example a liquid permeable first layer 20 and a liquid permeable second layer 30, with each layer of a single wipe 10 having the potential to have different liquid conductivity functions, wipes 10 stacked in a facing relationship can impede liquid distribution throughout the stack of wipes in a direction cross-plane to the wipes 10. In effect, a layer or layers of the wipes 10 can act as a capillary barrier to liquid movement through the stack of wipes 10 cross-plane to the wipes 10. A capillary barrier can arise when an upper layer, at a particular suction has a higher liquid conductivity than an adjacent underlying layer. The capillary barrier can cease to function when the suction is below the suction at which the liquid conductivity function of the upper layer and lower layer cross one another.

To overcome this potential for a capillary barrier effect in the wipes 10, it can be practical to orient the wipes 10 in the container 510 such that a longitudinal edge 32 is in contact with the closed end 520 of the container 510, as shown in FIG. 15. In such an arrangement, cleaning composition applied to the wipes 10 within the container 510 can be uniformly distributed downwardly to wet the wipe 10 in the longitudinal direction.

The container 510 can have a closed end 520 and an opposing opening end 530. The container 510 can extend between the closed end 250 and the opposing opening end 530. A container wall 40 can extend between the closed end 520 and opening end 530. The longitudinal edge 32 can be in contact with the closed end 520 of the container 510. The wipe 10 can be provided with a channel 250 that is proximal to the longitudinal edge 32 and extending away from the closed end of the container 510. Without being bound by theory, it is thought that a channel 250 can help distribute liquid through the wipe 10 along the pathway of the channel 250 by way of capillary action. By having the channel 250 extend away from the closed end of the container 510, free liquid cleaning composition that might accumulate at the closed end 520 of the container can be distributed up into the wipe 10 in the direction of the longitudinal axis L. This can help to result in a wipe 10 that is more uniformly wetted with liquid cleaning composition than if the wipes 10 are stacked in a facing relationship with the first side 330 or second side 340 facing and or contacting the closed end 520 of the container.

As shown in FIG. 15, the container 510 can have a closed end 520 and an opposing opening end 530. The opening end 530 can have a releasable and re-sealable closure 540. The releasable and re-sealable closure 540 can be an adhesive or a tongue and groove closure like that employed in a ZIPLOC bag. The opening end 530 be designed to be torn open and the consumer needs only to fold or roll the periphery of the opening end 530 to close the container 510. The consumer can use a clip or rubber band to secure the opening end 530 in a closed position.

The wipe 10 can have a longitudinal edge bond 400 as described herein. Like a channel 250, the longitudinal edge bond 400 can provide for capillary action to draw liquid from the closed end 520 of the container 510 into the wipe 10. A channel 250 can be proximal to the longitudinal edge bond 400 or can extend from the longitudinal edge bond 400 to assist in drawing liquid from the longitudinal edge bond 400 higher up into the wipe 10 within the container 500.

The container 510 can be a flexible bag 550. The container 510 can have a substantially flat closed end 15. A flexible bag can be formed from a polyethylene film, polyethylene terephthalate, or other pliable film. The wall thickness of the flexible bag can be greater than about 0.05 mm. The flexible bag 550 can have a closed end 520 that is gusseted. A non-limiting example of a gusset 560 is shown in FIG. 15. The container 510 can include a barrier layer, such as a thin foil layer, to reduce chemical transport through the wall of the container.

Figure 16:
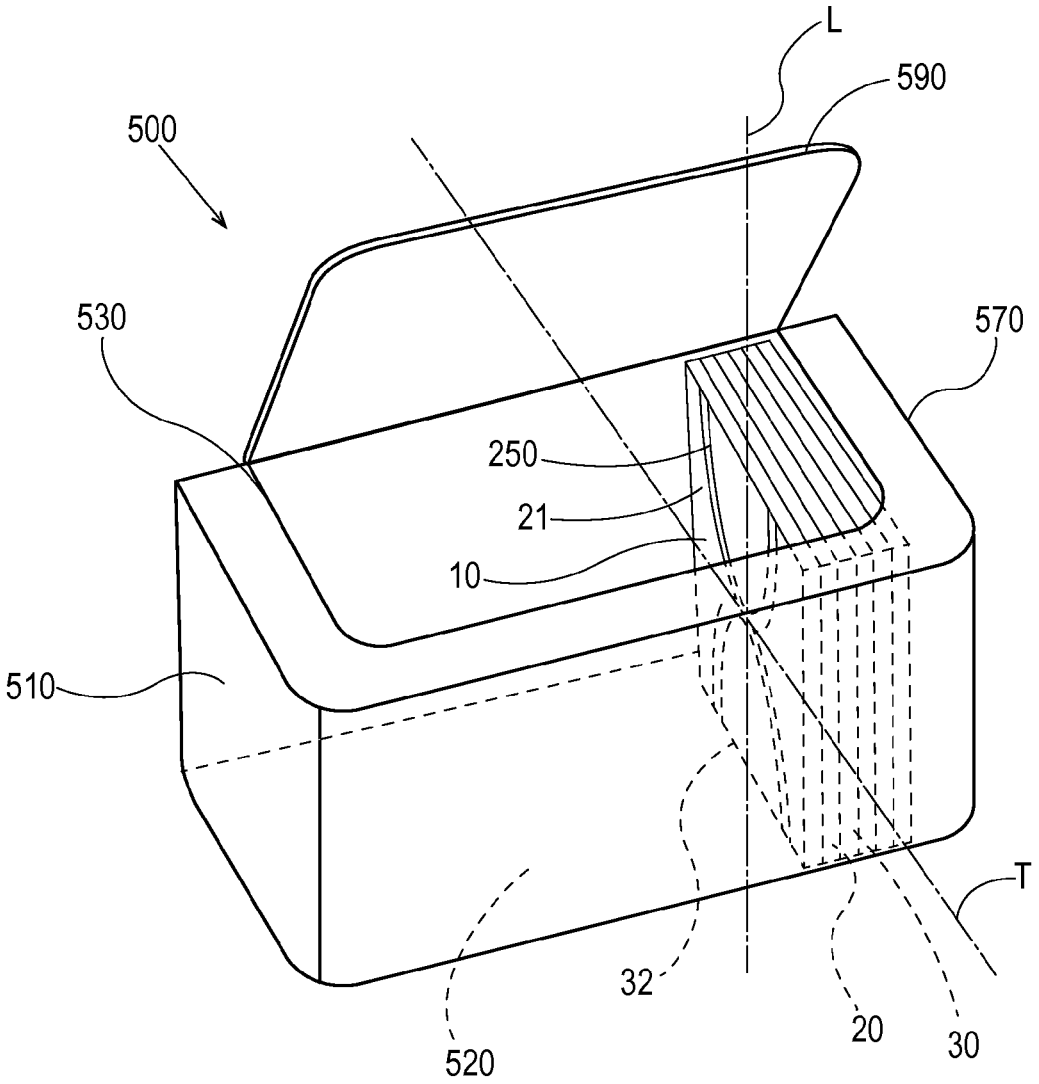
FIG. 16 is a package comprising a container and a plurality of wipes in which the container is a tub.

The container 510 can be a rigid tub 570, as shown in FIG. 16. A rigid tub 570 can have a design like tubs that are used to dispense stacked baby wipes. In a rigid tub 570, the closed end 520 can be connected to the opening end 530 via a plurality of panels 580. The opening end 530 can comprise a hingedly connected lid 590 that is releasable and re-sealable.

Figure 17:
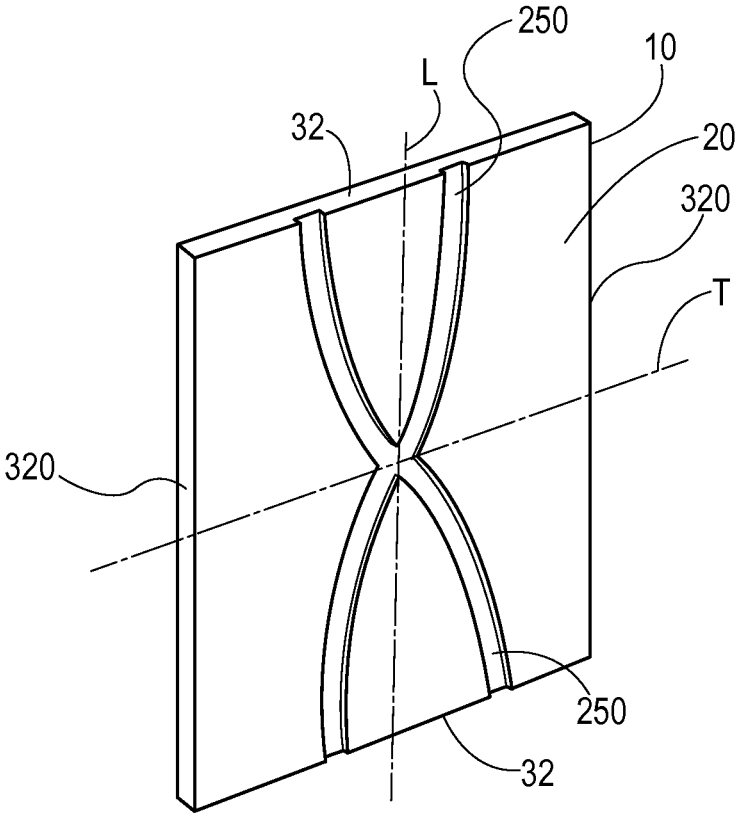
FIG. 17 is premoistened wipe having a channel.

The wipe 10 can comprise a liquid permeable first layer 20, as shown in FIG. 17. The wipe 10 can have a longitudinal edge 32 in contact with the closed end 320 of the container 510 and the wipe 10 can extend towards the opening end 530. The wipe 10 can comprise a channel 250 in the first layer 20. The channel 250 can be as described herein with the channel being provided in the first layer 20, proximal to the longitudinal edge 32 and extending away from the closed end 520 of the container 510. A single layer wipe 10 consisting of only a liquid permeable first layer 20 may be less expensive than a multilayer wipe 10. A channel in such a wipe 10 can help distribute liquid in the wipe 10 the same as in a multi-layer wipe 10. The first layer 20 can be comprised of a nonwoven, for example a spun bonded nonwoven, having sufficient caliper so as to permit a channel 250 to be embossed into the first layer. The first layer can have a caliper greater than or equal to about 1 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package comprising:

a container having closed end and an opposing opening end; and a plurality of premoistened cleaning wipes contained in said container, each said wipe comprising:

a liquid permeable first layer wherein said wipe further comprises a liquid permeable second layer joined to said first layer and in a facing relationship with said first layer, wherein said wipe further comprises a core disposed between said first layer and said second layer, said wipe having a longitudinal axis and a longitudinal edge extending across said longitudinal axis, wherein said longitudinal edge is in contact with said closed end of said container and said wipe extends towards said opening end of said container;

a channel proximal to said longitudinal edge and extending away from said closed end of said container; and a free liquid cleaning composition comprising between about 0.001% to about 10% by weight of said liquid cleaning composition of surfactant, said cleaning composition releasably absorbed in said wipe.

2. The package according to claim 1, wherein said longitudinal edge further comprises material from said core.

3. The package according to claim 2, wherein said channel extends to said longitudinal edge.

4. The package according to claim 3, wherein each said wipe comprises a plurality of channels each of which extend away from said longitudinal edge and extend away from said closed end of said container.

5. The package according to claim 4, wherein each said channel extends from said longitudinal edge to an opposing longitudinal edge.

6. The package according to claim 1, wherein said wipe further comprises a longitudinal edge bond disposed at a longitudinal edge of said wipe across said longitudinal axis, wherein said longitudinal edge bond comprises material from said first layer and said second layer.

7. A package comprising:

a container having closed end and an opposing opening end; and a plurality of premoistened cleaning wipes contained in said container, each said wipe comprising:

a liquid permeable first layer wherein said wipe further comprises a liquid permeable second layer joined to said first layer and in a facing relationship with said first layer, said wipe having a longitudinal axis and a longitudinal edge extending across said longitudinal axis, wherein said longitudinal edge is in contact with said closed end of said container and said wipe extends towards said opening end of said container, wherein said wipe further comprises a longitudinal edge bond disposed at a longitudinal edge of said wipe across said longitudinal axis, wherein said longitudinal edge bond comprises material from said first layer and said second layer;

a channel proximal to said longitudinal edge and extending away from said closed end of said container; and a free liquid cleaning composition comprising between about 0.001% to about 10% by weight of said liquid cleaning composition of surfactant, said cleaning composition releasably absorbed in said wipe, wherein said channel extends from said longitudinal edge bond to an opposing longitudinal edge bond.

8. The package according to claim 7, wherein said channel extends to said longitudinal edge.

9. A package comprising:

a container having closed end and an opposing opening end; and a plurality of premoistened cleaning wipes contained in said container, each said wipe comprising:

a liquid permeable first layer comprises a liquid permeable second layer joined to said first layer and in a facing relationship with said first layer, said wipe having a longitudinal axis and a longitudinal edge extending across said longitudinal axis, wherein said longitudinal edge is in contact with said closed end of said container and said wipe extends towards said opening end of said container;

a channel proximal to said longitudinal edge and extending away from said closed end of said container; and a free liquid cleaning composition comprising between about 0.001% to about 10% by weight of said liquid cleaning composition of surfactant, said cleaning composition releasably absorbed in said wipe, wherein said wipe further comprises a core disposed between said first layer and said second layer, wherein said longitudinal edge comprises material from said first layer and said second layer.

10. The package according to claim 9, wherein said channel extends from said longitudinal edge to an opposing longitudinal edge.

11. The package according to claim 1, wherein said wipe is sized and dimensioned to conform to an adult human hand.

12. The package according to claim 7, wherein said container is a rigid tub.

13. The package according to claim 7, wherein said container is a flexible bag.

14. The package according to claim 9, wherein said container is a bag and said closed end is gusseted.

15. The package according to claim, 9 wherein said channel is continuous.

16. The package according to claim 1, wherein said first layer is nonwoven.

17. The package according to claim 16, wherein each said wipe comprises a plurality of channels each of which is proximal said longitudinal edge and extend away from said longitudinal edge and extend away from said closed end of said container.

18. The package according to claim 1, wherein said opening end has a releasable and resealable closure.

* * * * *